US006106252A

United States Patent [19]

Yamanaka et al.

[11] Patent Number: 6,106,252

[45] Date of Patent: Aug. 22, 2000

[54] SCROLL COMPRESSOR

[75] Inventors: Toshio Yamanaka; Yukio Maeda; Kazuya Kato, all of Yokohama; Nobuo Abe, Ohira-machi; Minoru Tateno, Ohira-machi; Tatsuo Horie, Ohira-machi, all of Japan

[73] Assignee: Hitachi, Ltd., Tokyo, Japan

[21] Appl. No.: 09/245,348

[22] Filed: Feb. 5, 1999

[30] Foreign Application Priority Data

Feb. 20, 1998 [JP] Japan ..... 10-038355

[51] Int. Cl.[7] ..... F01C 1/02

[52] U.S. Cl. ..... 418/55.3; 464/104; 464/102; 29/888.02; 29/888.022; 29/557; 29/558

[58] Field of Search ..... 418/55.3; 464/104, 464/102; 29/888.02, 888.022, 557, 558

[56] References Cited

U.S. PATENT DOCUMENTS

| | | | |
|---|---|---|---|
| 5,842,845 | 12/1998 | Kawano et al. | 418/55.3 |
| 5,919,034 | 7/1999 | Kawano et al. | 418/55.3 |
| 5,931,651 | 12/1998 | Kawano et al. | 418/55.3 |

FOREIGN PATENT DOCUMENTS

| | | | |
|---|---|---|---|
| 0010482 | 1/1979 | Japan | 29/557 |
| 406010853 | 1/1979 | Japan | 418/55.3 |
| 407097990 | 1/1979 | Japan | 418/55.3 |
| 406088579A | 3/1994 | Japan | 418/55.3 |

OTHER PUBLICATIONS

Patent Abstract of Japan, English Abstract of Japanese Reference 1–305181 published on Dec. 8, 1989.

Patent Abstract of Japan, English Abstract of Japanese Reference 4–47184 published on Feb. 17, 1992.

Patent Abstract of Japan, English Abstract of Japanese Reference 2–9774 published on Jan. 12, 1990.

Patent Abstract of Japan, English Abstract of Japanese Reference 2–61381 Published Mar. 1, 1990.

Patent Abstract of Japan, English Abstract of Japanese Reference 7–269477 Published Oct. 17, 1995.

Patent Abstract of Japan, English Abstract of Japanese Reference 7–301101 Published Nov. 14, 1995.

*Primary Examiner*—Thomas Denion
*Assistant Examiner*—Thai-Ba Trieu
*Attorney, Agent, or Firm*—Antonelli, Terry, Stout & Kraus, LLP

[57] ABSTRACT

A scroll compressor has an Oldhams ring made of sintered metal operating as a rotation-prevention mechanism for holding the rotation scroll. The Oldhams ring is formed to a size to accommodate the cutting work or the grinding work of the surface processing during the forming of the sintered metal, and, as a result, the productivity of the Oldhams ring can be improved and the wear resistance becomes excellent. A scroll compressor that is inexpensive and has a high reliability may be made of a hard sintered metal which has an excellent wear resistance. A first groove 3*a* and the second groove 3*b* are formed in the end face 3 of the ring 2 of the Oldhams ring into the sintered metal. And, after the processing, the first groove 3*a* is deepest, and the depth is progressively reduced in order of the second groove 3*b* and the end face 3 in the Oldhams ring. The wear on the corner part of the tool, which is easiest to wear being used to process the side face of the keys is reduced due to the presence of these grooves.

6 Claims, 7 Drawing Sheets

SCROLL COMPRESSOR

BACKGROUND OF THE INVENTION

The present invention relates to a scroll compressor, and, more particularly, the invention relates to an Oldhams ring having a configuration which allows it to be manufactured more easily and with a reduced cost, thereby improving the productivity and cost of manufacture of a scroll compressor in which it is installed.

A scroll compressor has an Oldhams coupling which operates as a rotation-prevention mechanism for holding the rotation scroll. A typical scroll compressor of the type to which the present invention is directed will be described with reference to FIG. 6, which shows a cross section of the compression mechanism unit of the scroll compressor.

In a scroll compressor, as shown in FIG. 6, a crank shaft 15 is inserted in a bearing part 13*a* of a frame 13, and an eccentric member 15*a* of the crank shaft 15 is inserted in the bearing part 12*b* of a rotation scroll 12. The keys 14*a* of the Oldhams ring 14 that forms the Oldhams coupling are inserted in keyways 13*b* provided in frame 13 and keyways 12*c* provided in frame 12*c*, and the fixed scroll 11 is secured by a bolt 16 to the frame 13 in a state in which it engages with the rotation scroll 12.

A wrap 11*a* of vortex shape forming part of the fixed scroll 11 and a wrap 12*a* of vortex shape forming part of the rotation scroll move relative to each other due to the rotating motion, so that a gas is sucked in through a suction mouth pipe 18 provided in the fixed scroll 11, and the gas is compressed as it advances toward the center of the unit. The gas that is compressed is discharged from a discharge opening 11*b* at the center of the fixed scroll.

The scroll compressor shown in FIG. 6 operates as a compressor. The Oldhams ring 14 is formed to have the Oldhams coupling structure in that keys 14*a* are installed at both sides of the ring 14 and are inserted in the keyways 13*b*, 12*c* of the frame 13 and the rotation scroll 12. Therefore, with this Oldhams coupling structure, the rotation scroll 12 does not rotate, and the rotating motion of the rotation scroll 12 can be performed for the fixed scroll 11. An example of an Oldhams ring for a scroll compressor having the above structure is shown in JP-A-1-30518, wherein the Oldhams ring is manufactured by sintered metal molding, and cutting work or grinding is performed later on surfaces of the ring.

The sintered metal molding process molds a metal powder using a metal mold, and the molded metal is heated later to sinter the metal powder. A molding of sintered metal can accommodate a complexity and achieve a high precision in the molding of goods in the technical range that is achieved when a metal is molded by a die. But, the precision achieved in the molding of a sintered metal is inferior to the high precision that is attained by cutting work or grinding work. An efficient scroll compressor needs to be made of parts of high precision. Thus, it is necessary to do cutting work or grinding work to make the dimensions of the Oldhams ring and the precision of the shape precise when the Oldhams ring is formed by molding a sintered metal.

The problems associated with such manufacture will be explained by reference to the perspective view of the Oldhams ring shown by way of example in FIG. 7. An end face 14*c* of the Oldhams ring 14 shown in FIG. 7 is a which comes into contact face with the frame (not shown), and there is also a ridge line 14*d* with a key side face 14*b* on the same plane. The key 14*a* engages with the keyway of a frame (not shown) by way of the key side face. Therefore, the key side face 14*b* needs to be made even with the ridge line 14*d* in the neighborhood of the end face 14*c*. That is, the ridge line 14*d* needs to be processed to form a precise sharp corner. Thus, by cutting work or grinding work, both the key side face 14*b* and the end face 14*c* are processed, and the ridge line 14 is formed as a sharp corner.

In the process in which the Oldhams ring is manufactured of a sintered metal, the metal powder is molded by using a metal die to obtain the required shape. But, part of the ridge line 14*d* of the Oldhams ring is influenced by chamfering or a roundness provided in the metal die to improve the strength of the die. Thus, it is necessary to process both of the key side face 14*b* and the end face 14*c* to remove material from this ridge line 14*d*. Therefore, the conventional Oldhams ring is typically obtained by cutting or grinding both the key side face 14*b* and the end face 14*c*.

Then, if a ferrous metal is used, such as iron, a method of steam treatment may be employed as one of the surface treatment methods to be applied to the sintered ring. Steam treatment is a method of acidifying iron in high-temperature steam and forming a skin film of Fe304 thereon. According to this processing, the Oldhams ring can exhibit an improved wear resistance on slide surfaces due to the presence of an oxide film, and the function of preservation of the ring can be attained. While the volume of the Oldhams ring increases generally when a skin film of Fe304 is formed thereon by steam treatment, the volume increase is more evident at a sharp corner or edge than at other parts, with a result that the corner or edge swells after the steam treatment.

It was considered necessary, because the dimension is wrong when the buildup of the corner part occurs in the slide unit, for the slide unit to be processed after the steam treatment. Because the key side face 14*b* of each key 14*a* must engage in a keyway (not shown) so as to slide-freely, the key face 14*b* was processed and finished after the steam treatment. Here, the sintered metal is made from a metal powder, and it is not made to melt perfectly in the manufacturing process, so that holes are left in the metal powder. The holes in a sintered metal body range from the surface to the inside, and the skin film of Fe304 is formed on the inside as well as on the surface due to the steam treatment. Therefore, even if the surface is processed and partly removed after the steam treatment, there is a skin film of the internal portion Fe304 remaining on the surface, and so the wear resistance can be improved.

Therefore, it is typical that, in the case of performing a steam treatment on an Oldhams ring made of a sintered metal, the Oldhams ring is first sintered, and then the steam treatment is done and the cutting work or the grinding work is done later. A scroll compressor using an Oldhams ring on which cutting work or grinding work has been performed on both the key end face and the key side face, has the following problems.

The first problem is as follows. The sintered metal has holes, and the heat conductivity is wrong. Thus, the temperature of the tool becomes high during processing. And, a vibration easily occurs due to the intermittent processing caused by the presence of the holes. Thus, the ease of cutting is poor as compared with a powder material and melt goods formed of a steel product for the same component, etc. Therefore, the use of a sintered metal has the advantage that it is possible to achieve a very accurate shape for a final product obtained by molding with a die that is excellent in productivity. But it has a fault in that the wear on the tool is remarkable during processing. In this regard, a problem which occurs at the time of the cutting work on the Oldhams ring made of sintered metal using an end mill as a processing tool will be explained.

The part of an end mill where the wear is most remarkable is at the corner part of the cutting blade tip of acutent shape. On the other hand, as for the shape of a conventional Oldhams ring made of sintered metal, the ridge line between the key side face and the end face has pads, and so the machining allowance enlarges. This ridge line is processed by the corner part of cutting blade tip of the end mill. Therefore, the wear on the end mill is remarkable for processing a large part of the machining allowance of the hard sintered metal with the part of the end mill which is easiest to wear. And, as for the conventional Oldhams ring shape, the processing of the key side face and the end face is necessary.

When the end face processing using the lower edge of the end mill and the side face processing using an outer peripheral edge of the end mill are generally compared, the length where the corner of the cutting blade tip touches a part of the end face being processed is very long. Therefore, comparing the side face processing with the end face processing, the end mill wears more easily in the end face processing. That is, when the key side face and the end face are processed, during the end face processing the tool becomes remarkably worn compared to the tool wear which occurs during the key side face processing.

As described, because, in the processing, a large part of the machining allowance of the hard sintered metal is processed with the part of the end mill which is easiest to wear, that is, the processing occurs at the end face with the part of the tool which is easy to wear, the tool used to process the Oldhams ring of the conventional sintered alloy is remarkably worn and the productivity in the manufacture of the Oldhams ring is a problem.

When the Oldhams ring is processed with a grinder, that, when is the end face of the Oldhams ring is processed by using the end face of a cylindrical grinder, there is also a problem of very large wear at the corner part of the grinder. As for a scroll compressor using an Oldhams ring having this problem, there is a problem concerning the improvement of the productivity and the reduction of the cost.

The second problem is as follows. In the steam treatment to improve the wear resistance of a slide part, the volume increase produced by generation of the Fe304 causes a sharp corner to swell in size. When the steam treatment is done on an Oldhams ring which has sharp corners and edges in the slide portion, a processing to remove the buildup must be carried out after the steam treatment is done. But when the steam treatment is performed on a sintered metal, and Fe304 is formed, the tool wear becomes more remarkable and the processing becomes more difficult than for a sintered metal on which the steam treatment is not done. Therefore, the productivity of the Oldhams ring becomes much worse. This problem results in a further reduction in the productivity of a scroll compressor and a further increase in cost, added to the effects of the first problem.

The third problem is as follows. There is a problem of poor productivity of the scroll compressor and an increase in the cost of the compressor and an air conditioner which uses the scroll compressor as a result of the first problem and the second problem mentioned above.

SUMMARY OF THE INVENTION

The present invention solves the first and the second and third problems mentioned above.

To solve the first problem, in the cutting work or the grinding work on the hard sintered metal, the processing of the end face with the corner of the tool which is easiest to wear is avoided, and the processing of the side face only is carried out using the side of the tool, whereby manufacture of the Oldhams ring is carried out more efficiently.

Then, to solve the second problem, the corner of the key is given a round shape, so that the sharp angle at the edges is lost, and so a buildup does not arise during steam treatment. As a result, the processing of the hard sintered metal before steam treatment is facilitated, and the Oldhams ring can be inexpensively produced. And, to solve the third problem, the scroll compressor is mounted in an air conditioner such that the first and second problems are solved, thereby enabling a reduction of the cost the air conditioner.

DETAILED DESCRIPTION OF THE PREFERRED EMBODIMENTS

Figure 1:
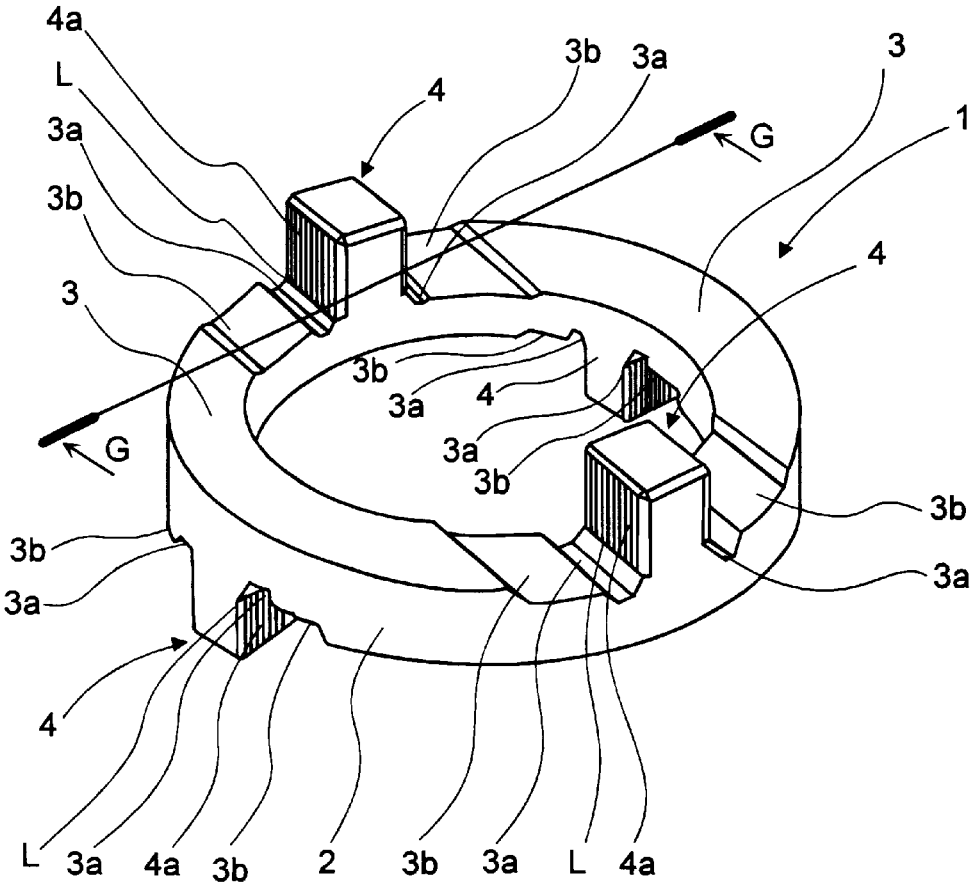
FIG. 1 is a perspective view showing an example of the structure of the Oldhams ring of a present invention.

Referring to the drawing, an example of the present invention will be explained. FIG. 1 is a perspective view that shows the shape of the Oldhams ring for a scroll compressor according to the present invention.

As shown in FIG. 1, each key 4 is formed to project from a ring 2, and the axial direction of the Oldhams ring 1 is a direction which is orthogonal to the end face 3 of ring 2. At the base of each key side face 4*a*, a first groove 3*a* is formed, and a second groove 3*b* is formed to extend to the first groove 3*a*. As for the height relationship in the axial direction of the Oldhams ring 1 between the first groove 3*a* and the second groove 3*b* and the end face 3, the first groove 3*a* is lowest, and the height increases in the order of the second groove 3*b* and the end face 3. In the finishing processing of the key side face 4*a*, because of the presence of the first groove 3*a* and the second groove 3*b*, the processing of the key side face 4 can be carried out without allowing the bottom face of the tool, which is easy to wear, contact the surface of the ring 2.

The Oldhams ring 1 shown in FIG. 1, as an example, is manufactured of a sintered alloy. The sintered alloy is formed by molding a metal powder using a die (not shown), heating the molded element, and diffusing the junctions of metal powder. The use of a sintered alloy formed by a molding method compared with a method, such as forging or casting and so on, results in a high precision. The first groove 3*a* and the second groove 3*b* are provided so that the bottom part of the processing tool does not touch the surface of the ring 2. And, because the sintered alloy is molded using a die, a high precision can be sufficiently attained, and the manufacturing of the first groove 3*a* and the second groove 3*b* can be achieved efficiently.

The Oldhams ring 1 shown in FIG. 1 represents an example of forming the keys 4 on both sides of the ring 2. However, the keys 4 may be provided only on one side, and so a plane which is parallel to the side face of annulus ring 2 is set up. There is also an example of doing the duty of other keys 4. In this case, the keys 4 exist only on only one side, and if the first groove 3*b* and the second groove 3*b* exist only on the one side, the function of the invention can be accomplished.

In the example shown in FIG. 1, the keys 4 are installed on both sides of the ring 2, and the first groove 3*a* and the second groove 3*b* are also provided on both sides. Then, in the finishing processing of the key side faces 4*a*, it is possible to finish the key side face 4*a* without allowing the bottom of the tool, which is easy to wear, to touch the surface of the ring 2. The cutting work is done on the key side face 4*a* to establish the width of the key side face 4*a* with high-precision. In this case, the grinding work is higher precision than the cutting work in the processing pf the Oldhams ring. The face except for the key side face 4*a* is formed by a molding process for obtaining a sintered metal. A chamfering of a corner or a roundness of an edge also can be produced by the cutting work or the grinding work. The lower limit L in the range in which the key side face 4*a* is cut is higher than the second groove 3*b* and sets lower than the end face 3. The positional relationship is the same in the case of the grinding work.

Figure 2A:
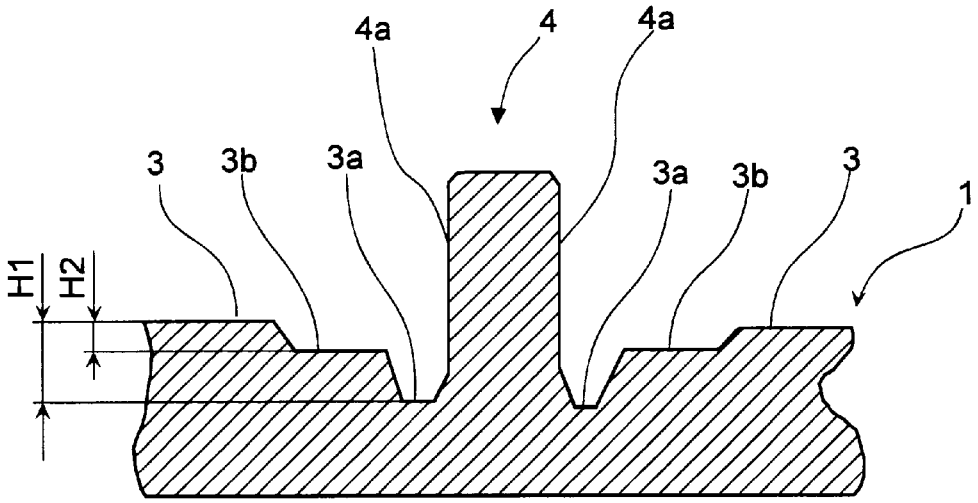
FIGS. 2(*a*) and 2(*b*) are cross-sectional views which show the position and the shape of a groove and the use of an end mill in the manufacture of the Oldhams ring.
Figure 2B:
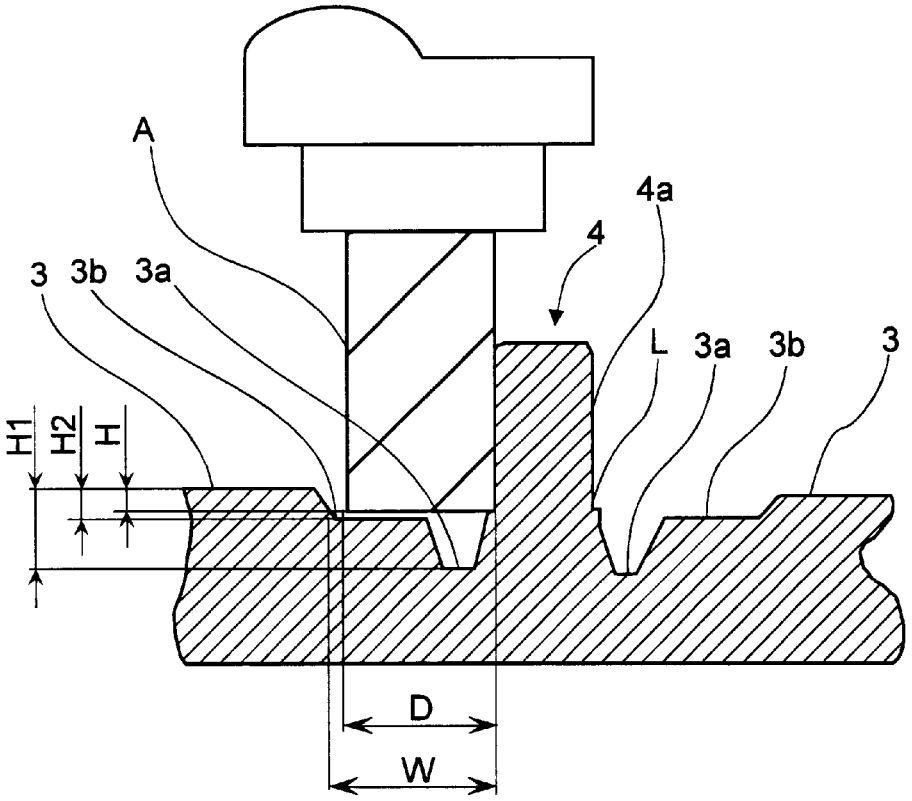

FIGS. 2(*a*) and 2(*b*) illustrate the range of cut work and the grinding work. FIG. 2(*a*) is a section of the Oldhams ring 1 after sintering, and FIG. 2(*b*) shows an example of the cutting work by an end mill. The cross-sectional view shown in FIGS. 2(*a*) and FIG. 2(*b*) is taken along the line G—G in FIG. 1.

In FIG. 2(*a*), the depth H1 of the first groove 3*a* is deeper than the depth H2 of the second groove 3*b*, and the end face 3 is highest. Therefore, the key side face 4*a* needs to be processed at least to the plane of the end face 3 or to a deeper position so that interference with the keyway does not arise. For this requirement, when molding the key side face 4*a*, the first groove 3*a* provides an even greater depression to accommodate the processing, and sets a uniform manufacturing allowance. And, the second groove 3*b* is prepared to be able to process the key side face 4*a* from the end face 3 to a deep position without using the bottom edge of the end mill which processes the key side face 4*a*. FIG. 2(*b*) shows the position of the end mill as it processes the side face 4*a*. The diameter D of the end mill is smaller than the total value W of the combined width of the first groove 3*a* and the width of the second groove 3*b*, and the depth to which the end mill A passes is H.

With such a configuration, the bottom edge of the end mill A does not touch the end face 3 or the bottom of the second groove 3*b*, and only the key side face 4*a* is processed. The lower limit L in the range that end mill A extends in the processing of the side face 4*a* becomes in the depth H, which is set below the position of the end face 3. There is no generation of pads in the processing range of the key side face 4*a*, and the machining allowance is made uniform over the whole of the key side face, resulting in an improved tool life and good precision in the manufacture of the Oldhams ring.

In accordance with the present invention, a groove of two steps consisting of the first groove 3*a* and the second groove 3*b* is provided in the ring 2. However, when a single step groove is provided as a deep and wide groove, an equivalent effect can be attained. But the extent of occurrence of a reduced dimension in the cross section of the ring 2 increases in this case. In the use of sintered metal, a fluctuation in the cross section is associated with a fluctuation in the density, and so a fluctuation in the strength occurs in ring 2, which is not desirable. It is desirable that the groove be made as shallow as possible in the range W when preparing a groove of two steps, from the point of view of strength, like the present invention, which requirement is satisfied in the depth H1 and the depth H2, and when the width W also is narrowed to the utmost.

As it is described above, the first groove and the second groove are formed during molding of the sintered material, and the Oldhams ring processed only on the key side face lends itself to favorable productivity using the hard sintered metal. And, a scroll compressor which employs such an Oldhams ring can be manufactured at a reduced cost. The foregoing description has been directed to an example of an Oldhams ring made of a sintered metal, but the Oldhans ring may be manufactured by a forging or an injection molding technique using a material other than a sintered metal.

Figure 3:
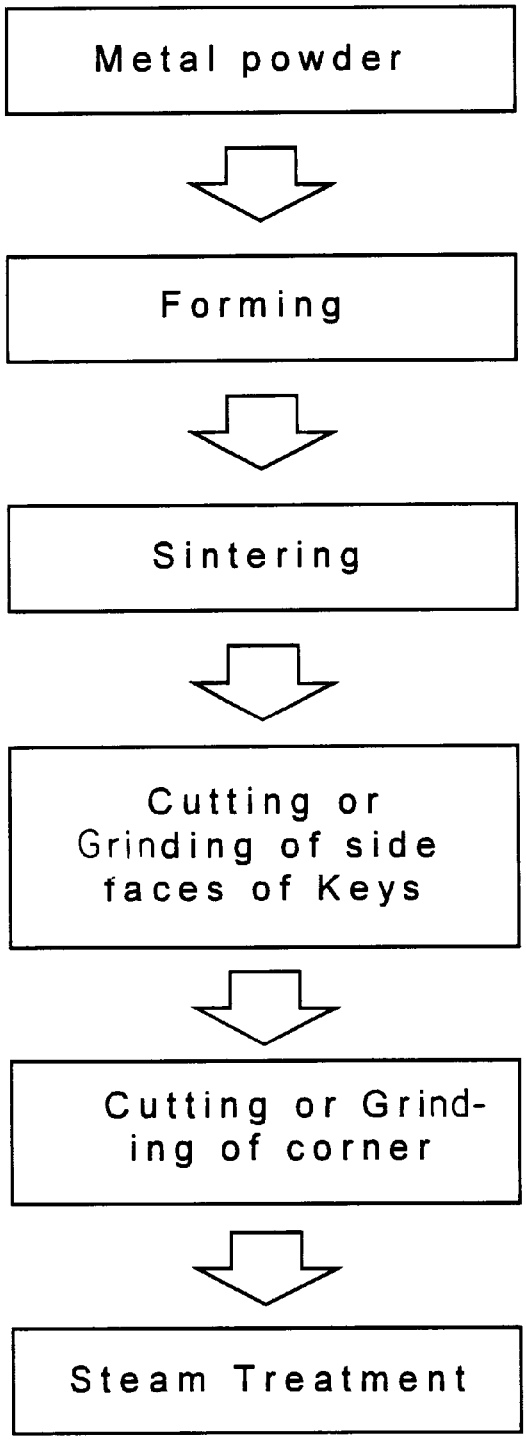
FIG. 3 is a flow diagram which shows the manufacturing process of the Oldhams ring.

Next, by using FIG. 3, an example of the manufacturing process of the Oldhams ring will be described. In the manufacturing process shown in FIG. 3, the Oldhams ring is formed by molding a metal powder, which is then sintered, and the side face of the ring is subjected to cutting or grinding after the sintering. The corner of the ring is processed by cutting or grinding, and the Oldhams ring is then subjected to steam treatment in which a skin film of Fe304 is formed thereon.

The Oldhams ring is processed to round the key edges before the steam treatment, and the steam treatment is then performed. In the manufacturing process shown in the FIG. 3, the order of the key side face processing and the corner processing can be reversed, or the corner processing can be included as part of the key side face processing. In addition, the rounding of the corners or chamfering can be provided in the molding process, so that the corner processing can be omitted. In the manufacturing process of this Oldhams ring the edges of the key can be made round and steam treated later.

Figure 4:
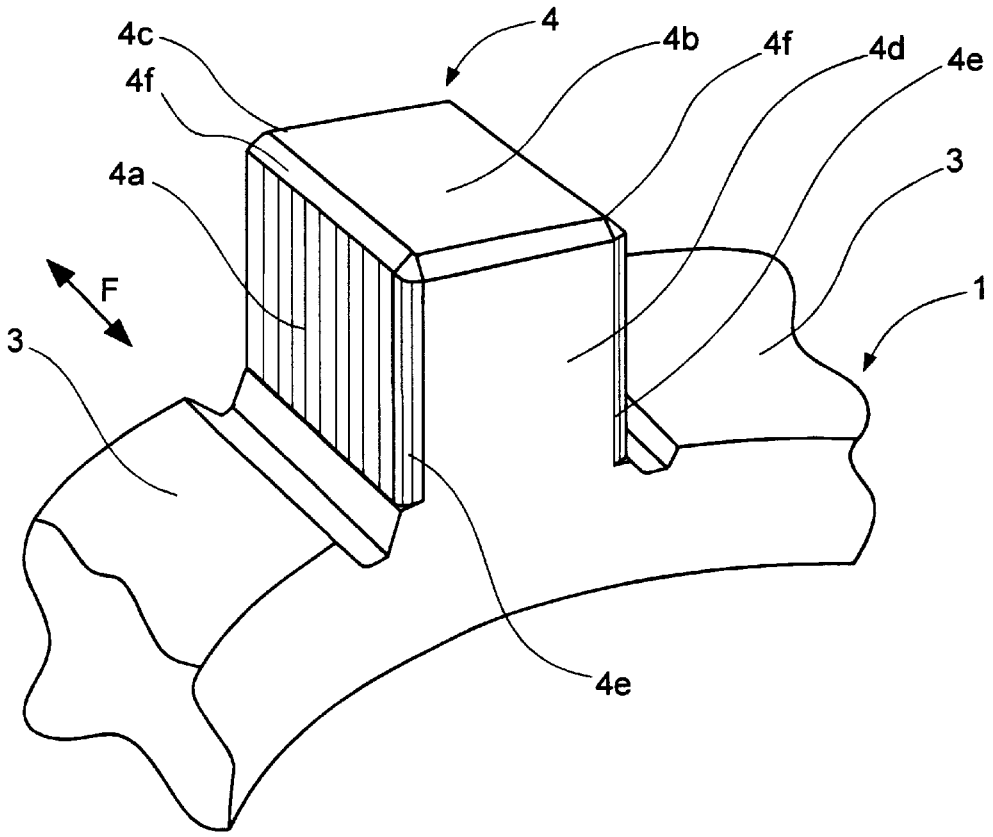
FIG. 4 is a perspective view which shows the key part of the Oldhams ring.

The rounding of the edges of the key 4 of the Oldhams ring will be explained with reference to FIG. 4, which is a perspective view showing the key 4 of the Oldhams ring. Here, the rounding of the side face edges 4*e* can be produced during the process in which the metal powder is molded, or it can be formed during the cutting or grinding work in the process of chambering the key 4. There is no sharp corner on the key 4 when the corner is rounded like this. Therefore, formation of a buildup which is orthogonal to the F direction, which is the motion direction of the Oldhams ring 1, is prevented even if steam treatment is performed. Because only the ridge line is parallel to the motion direction of the Oldhams ring 1, the upper surface chambering 4*f* is all right by a chamfering formed in the plane. And, the upper surface chambering part can be rounded.

As indicated by the above explanation, because there is no sharp corner on the keys 4, since both edges of the key side face have a round shape, the formation of a buildup which extends in an orthogonal direction due to the steam treatment can be tolerated. In addition, because the surfaces of the keys are processed before the steam treatment, it is possible to effect processing under conditions where the tool wear is small and the productivity is excellent. Therefore, the production cost of the scroll compressor which employs this Oldhams ring is cheap.

Figure 5:
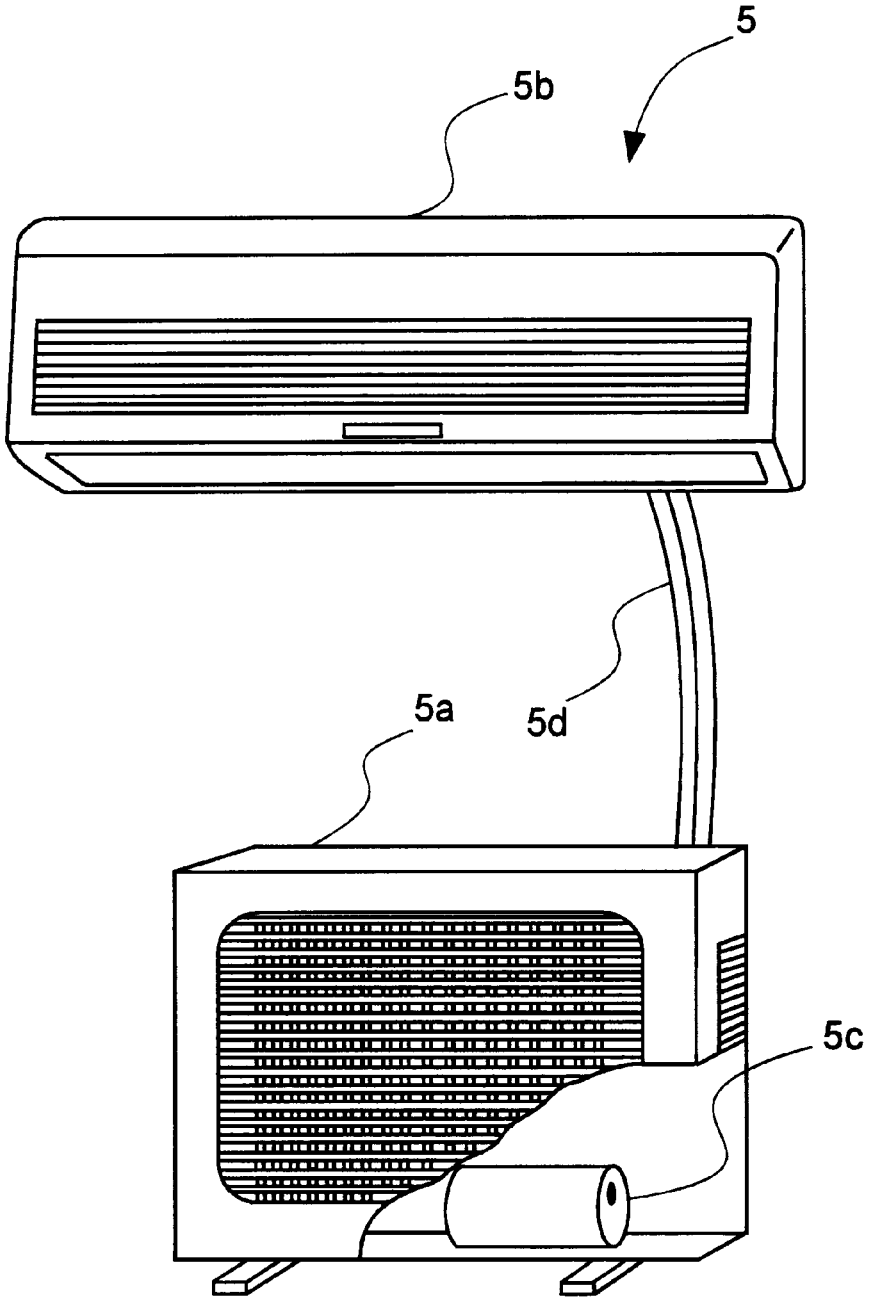
FIG. 5 is a perspective view showing the structure of a room air conditioner having a scroll compressor on which the Oldhams ring of a present invention is mounted.
Figure 6:
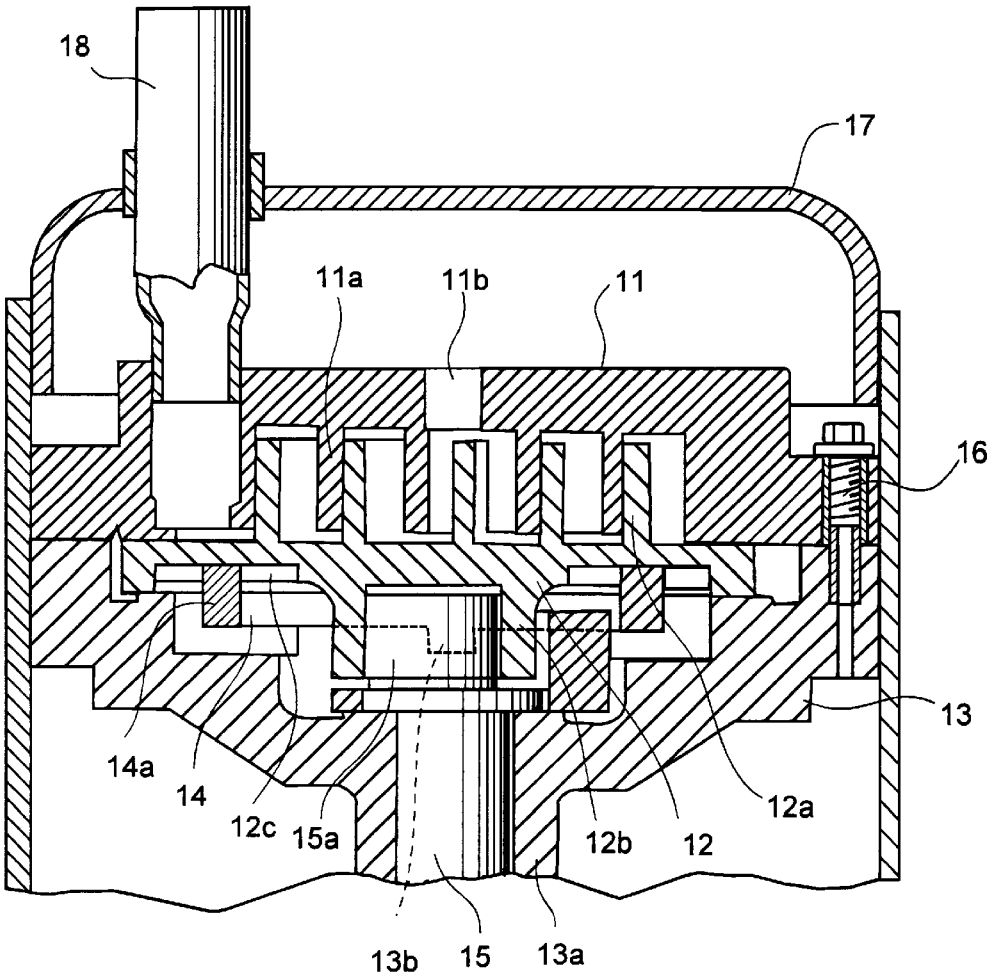
FIG. 6 is a cross section of the compressor mechanism of the scroll compressor.
Figure 7:
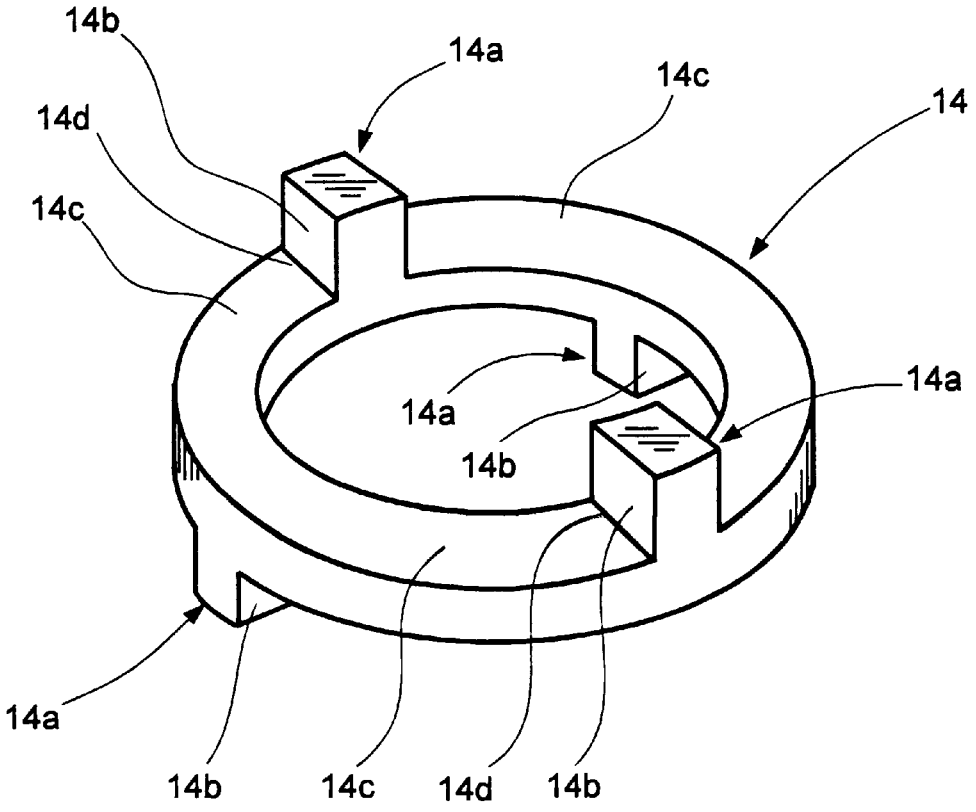
FIG.7 PRIOR ART
FIG. 7 shows the perspective view of a conventional Oldhams ring.

An example of an air conditioner having a scroll compressor which mounts the Oldhams ring of the present invention will be described. FIG. 5 is a perspective view of a room air conditioner which employs a scroll compressor that mounts the Oldhams ring of the present invention. The room air conditioner is of the separate type of air conditioner.

In FIG. 5, the air conditioner 5 consists of a machine 5*a* located outside the room, which employs a scroll compressor 5*c* and a machine 5*b* located inside the room, and the machines 5*a* and 5*b* are connected by a connection pipe 5*d*. In the room air conditioner shown in the FIG. 5, the refrigerant (not shown) is compressed by the scroll compressor mounted on the machine 5*a* located outside the room, and is sent to the machine 5*b* located inside the room through the connection pipe 5*d*. The refrigerant then circulates back to the scroll compressor 5*c* located in the machine 5*a* outside the room, and the cycle is completed. In the process of this cycle, the function as an air conditioning machine is accomplished by a radiation action and an endoergic action produced by the refrigerant. The scroll compressor 5*c* shown in FIG. 5 is the important mechanism that causes the refrigerant gas to circulate and is a high-priced part. However, since the scroll compressor 5*c* of the present invention can be manufactured at a reduced cost, it has the effect of reducing the overall cost of the air conditioner 5.

As an effect of the present invention, the first problem that exists conventionally can be solved. That is, the Oldhams ring is constituted, of hard sintered metal, and a groove having two steps is provided therein, so that the subsequent surface processing is confined to only the key side face, and the processing of the pads and the end face is omitted. As a result, an Oldhams ring which has a low processing cost can be obtained, and a scroll compressor using the Oldhams ring and which has a low manufacturing cost can be obtained.

And, the second problem which has occurred conventionally can be solved. That is, the keys do not have a sharp edge or corner since both edges of the key side face have a rounded shape, whereby buildup is not formed in the motion direction of the Oldhams ring during the steam treatment. As a result the Oldhams ring can be made of an inexpensive sintered alloy with good durability, and an inexpensive scroll compressor, the reliability of which is high, as a result, can be obtained.

In addition, the third problem that has occurred conventionally can be solved. That is, by providing an inexpensive scroll compressor having a high reliability, the production cost of the air conditioner can be reduced, and the operation reliability can be improved.

What is claimed is:

1. A scroll compressor of the type which contains a fixed scroll and an orbiting scroll wherein an Oldhams ring is provided as a rotation-prevention mechanism for holding the orbiting scroll against rotation, but permitting it to revolve with an orbiting motion, characterized by the Oldhams ring being provided as a circular ring and having keys extending from at least one planar surface of the circular ring, wherein a first groove is formed at the junction of the planar surface and the side face of the keys, and a second groove is formed adjacent the first groove and in communication therewith, the first groove being deeper than the second groove.

2. A scroll compressor as described in claim 1 wherein said Oldhams ring is made of sintered alloy.

3. A scroll compressor as described in claim 1 wherein said first groove and said second groove are formed on the both side of said Oldhams ring.

4. A method of manufacture of an Oldhams ring for a scroll compressor which contains a fixed scroll and an orbiting scroll wherein the Oldhams ring is provided as a rotation-prevention means for holding the orbiting scroll against rotation, but permitting it to revolve with an orbiting motion, comprising the steps of:

forming a first groove at a junction of a planar surface from which keys project and the side face of the keys of the Oldhams ring;

forming a second groove adjacent the first groove and in communication therewith, the first groove being deeper than the second groove; and using a cutting or grinding tool to cut or grind the side faces of the keys on the condition that the end face of the tool passes to a level between the bottom of the second groove and said planar surface.

5. A method of manufacture of an Oldhams ring for a scroll compressor which contains a fixed scroll and an orbiting scroll wherein the Oldhams ring is provided as a rotation-prevention means for holding the orbiting scroll against rotations but permitting it to revolve with an orbiting motion, comprising the steps of:

performing a sintering process on powder metal wherein a first groove is formed at a junction of a planar surface from which keys project and the side face of the keys of the Oldhams ring, and a second groove is formed adjacent the first groove and in communication therewith, the first groove being deeper than the second groove;

performing a process wherein the corners of the keys of the Oldhams ring are cut or ground to a round shape; and subjecting the Oldhams ring to a steam treatment.

6. An air conditioner which comprises a scroll compressor as described in claim 1 or claim 2 or claim 3.

* * * * *